US007048425B2

(12) United States Patent
You et al.

(10) Patent No.: US 7,048,425 B2
(45) Date of Patent: May 23, 2006

(54) LED SIGNAL WITH SIDE EMITTING STATUS INDICATORS

(75) Inventors: Chenhua You, Manasquan, NJ (US); John T. Adinolfi, Milltown, NJ (US); Kurt A. Kulberg, Hillsborough, NC (US); Michael F. Picciotti, Toms River, NJ (US)

(73) Assignee: Dialight Corporation, Farmingdale, NJ (US)

( * ) Notice: Subject to any disclaimer, the term of this patent is extended or adjusted under 35 U.S.C. 154(b) by 40 days.

(21) Appl. No.: 10/671,505

(22) Filed: Sep. 29, 2003

(65) Prior Publication Data

US 2005/0068771 A1 Mar. 31, 2005

(51) Int. Cl.
*F21V 33/00* (2006.01)
*B60Q 1/26* (2006.01)

(52) U.S. Cl. ..... 362/555; 362/540; 362/240

(58) Field of Classification Search ..... 362/307, 362/327, 339, 511, 540, 541, 542, 545, 555, 362/581, 582, 800, 487, 493, 494, 506, 507, 362/551, 240, 245

See application file for complete search history.

(56) References Cited

U.S. PATENT DOCUMENTS

| | | | | |
|---|---|---|---|---|
| 1,462,065 | A * | 7/1923 | Lee | 362/549 |
| 1,810,216 | A * | 6/1931 | Kurtz | 362/506 |
| 2,041,315 | A * | 5/1936 | Barclay | 362/506 |
| 4,751,617 | A * | 6/1988 | Ryder et al. | 362/511 |
| 6,767,111 | B1 * | 7/2004 | Lai | 362/800 |
| 2002/0080615 | A1 * | 6/2002 | Marshall et al. | 362/555 |

* cited by examiner

*Primary Examiner*—Y. My Quach-Lee
(74) *Attorney, Agent, or Firm*—Oblon, Spivak, McClelland, Maier & Neustadt, P.C.

(57) ABSTRACT

A light device including side emitting status indicators that provide a true indication of whether light is being output in a primary output direction. The light device includes a light source of at least one LED configured to generate light in the primary output direction. The light generated by the at least one LEDs passes through a lens device, that may also reflect a portion of the light generated from the at least one LED. Collection optics are provided to capture a portion of the generated light and/or the reflected portion of the light generated from the light source, and are configured to output the captured generated and/or reflected light in a direction other than the primary direction, i.e., in a direction for the side emitting status indicators.

20 Claims, 2 Drawing Sheets

FIG. 3
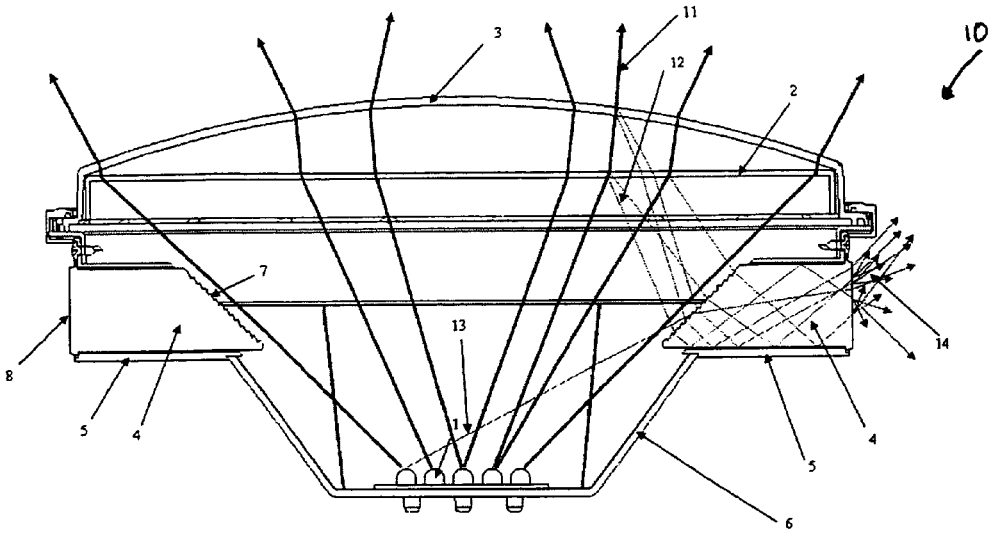
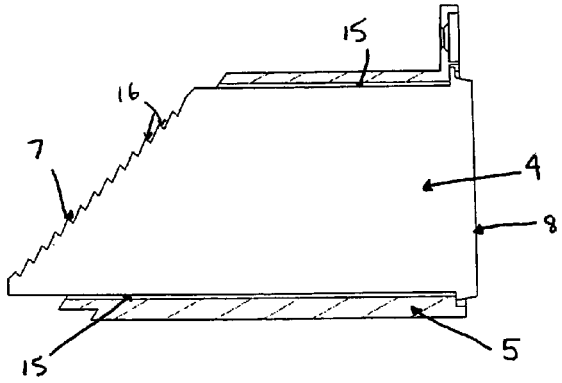
FIG. 4
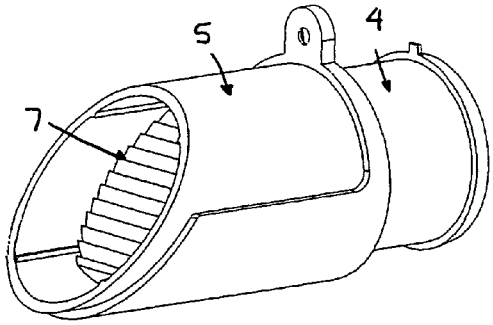
FIG. 5

LED SIGNAL WITH SIDE EMITTING STATUS INDICATORS

BACKGROUND OF THE INVENTION

1. Field of the Invention

The present invention relates to a signal that includes side emitting status indicators, and in particular in which the signal includes an LED light source. Such a signal can find application, for example, as a railway indicating signal.

2. Discussion of the Background

A typical railway indicating signal utilizes an incandescent light bulb as a light source. Such a railway signal may be employed at a railway crossing. In that type of signal the light emitted from the incandescent light bulb passes through at least one red lens to provide a primary red signal to an oncoming motorist crossing the rail tracks. Also, two additional light ports, one on each side, may be provided to provide objective evidence to a train operator that the light bulb is properly outputting light to the oncoming motorist. That is, an operator on the train can view light output from the additional light ports to confirm that the light bulb in the railway crossing light is properly operating. In that operation the light provided to the additional light ports is directly collected from the light source, i.e., the incandescent light bulb, by an optical window that utilizes prism features, and which refracts light in the desired direction.

SUMMARY OF THE INVENTION

One object of the present invention is to provide a novel signal, such as a railway indicating signal that utilizes an LED light source and that provides an accurate side emitting status indication.

The present inventors have recognized that as LED light sources become more and more available, LED light sources may be utilized in signal applications. However, most LEDs provide substantially directional light. In the context of a railway signal, the light output by an LED light source may pass through a lens or lenses providing signals to oncoming motorists. In such a case, since the LEDs provide substantially directional light, in a device such as a railway light with side emitting status indicators, there is typically insufficient light reaching the side emitting status indicators for a train operator to view because of the directional nature of the LEDs.

One way to solve that problem is to add additional LEDs to be directed to the side emitting status indicators. However, that approach does not provide a failsafe indication to a train operator since those additional LEDs may not always operate the same as the primary LEDs providing the light signal in a primary direction to an oncoming motorist. That is, the situation may arise that the LEDs providing a light signal in a primary direction to an oncoming motorist are not properly working, but different side facing LEDs providing light in a secondary direction to side emitting status indicators are properly working. In that instance, the train operator would not be given on accurate indication.

Accordingly, a more specific object of the present invention is to provide a novel LED signal with side emitting status indicators that provides a true indication of the light provided in a primary light output direction.

To achieve the above and other objects, the present invention sets forth a novel light device including a light source of at least one LED configured to generate light in a primary direction. A lens device through which the light generated from the light source passes is also provided. That lens device, however, also reflects a portion of the light generated from the light source. Collection optics are configured to capture the reflected portion of the light generated from the light source, and are configured to output the captured reflected light in a direction other than the primary direction, i.e. in a direction for the side emitting status indicators.

BRIEF DESCRIPTION OF THE DRAWINGS

A more complete appreciation of the present invention and many of the attendant advantages thereof will be readily obtained as the same becomes better understood by reference to the following detailed description when considered in connection to the accompanying drawings, wherein:

FIG. 3 shows a side view of the internal structure of the light device of the present invention that additionally indicates various light paths;

FIG. 4 shows a side internal view of specific collection optics for a side emitting status indicator in the novel light device of the present invention; and FIG. 5 shows a perspective view of the collection optics for the side emitting status indicator of the present invention.

DESCRIPTION OF THE PREFERRED EMBODIMENTS

Figure 1:
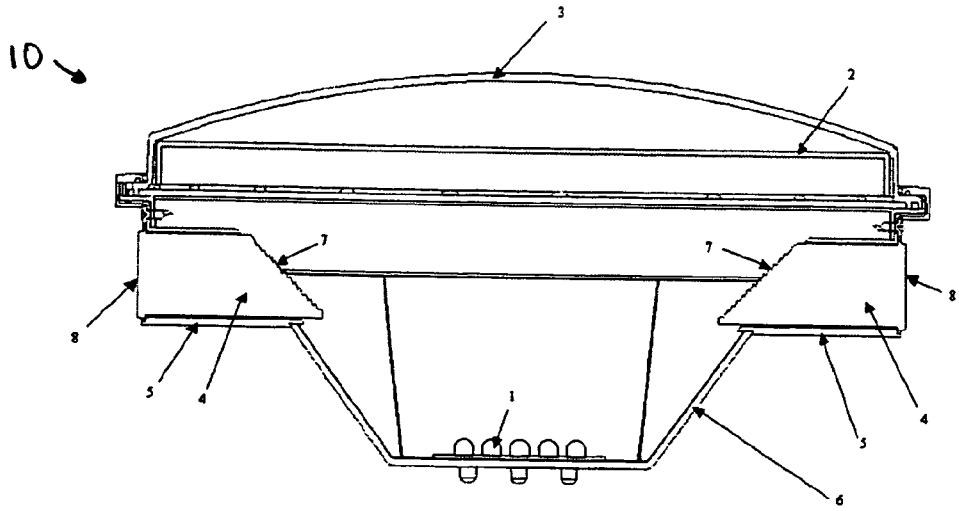
FIG. 1 shows a side view of the internal structure of the novel light device of the present invention.
Figure 2:
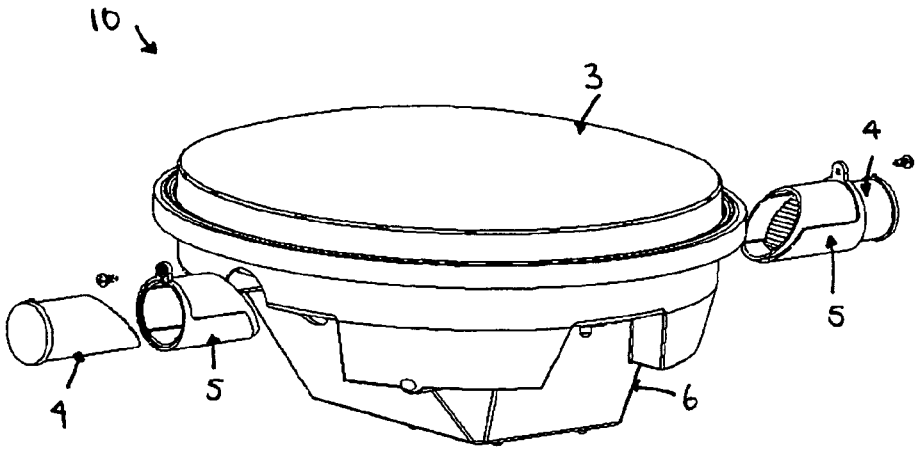
FIG. 2 shows a perspective view of the novel light device of the present invention with certain elements in an exploded view.

Referring now to the drawings, wherein like reference numerals identify identical or corresponding parts throughout the several views, and more particularly to FIGS. 1 and 2 thereof, views of a light device 10 of the present invention are shown. FIG. 1 shows an internal view of the light device 10, and FIG. 2 shows the light device 10 from a perspective view with certain elements exploded out.

As shown in FIGS. 1 and 2, the light device 10 includes an overall housing 6 that serves to house each of elements of the light device 10. The housing 6 can be formed of any suitable metal or plastic material. The light device 10 also includes a plurality of light emitting diode (LED) light sources 1. The number of LEDs 1 can vary based on the specific type of LEDs utilized.

The light device 10 also includes two lenses of an inner lens 2 and an outer lens 3. Light output from the LEDs 1 predominantly passes through the inner lens 2 and the outer lens 3 in a primary direction to provide a light indication signal. In the context of a railway indicator an oncoming motorist will view the light output from the LEDs 1 and passing through the inner lens 2 and the outer lens 3.

The light device 10 also includes additional side emitting status indicators formed of elements 4–8. The side emitting status indicators provide an indication signal in a direction other than the primary direction from which light from the LEDs is output. Element 4 is a light pipe that directs light collected at a collecting surface 7 to an exit surface 8. The exit surface 8 can be frosted to provide a diffused uniform illumination. The light pipe 4 may be made from plastics or glass or other optical materials. The light pipe 4 is held in place by a sleeve 5. In the context of a railway indicator, a train operator will be able to view light output from the exit surface 8 to have an indication whether the LEDs 1 are properly operating, and to thereby give an indication whether an oncoming motorist is receiving a proper indication signal.

The operation of the output of light from the LEDs 1 is shown in further detail in FIG. 3, which shows the light device 10 with generated light beams.

With reference to FIG. 3, the LEDs 1 output primary light beams 11 to be output in a primary direction, i.e., the majority of the light beams 11 pass through the inner lens 2 and the outer lens 3 and then become viewable by, for example, an oncoming motorist. While the primary light beams 11 pass through the inner lens 2 and the outer lens 3, a portion of the primary light beams 11 are reflected at the surfaces of the inner lens 2 and the outer lens 3 based on Fresnel losses, and those reflected light beams result in Fresnel loss beams 12. Those Fresnel loss beams 12 are collected by the collecting surfaces 7 of the light pipes 4, which are formed on each side of the light device 10, although FIG. 3 only shows the collection of the Fresnel loss beams 12 at one of the light pipes 4. The collecting surfaces 7 of the light pipes 4 are formed with a plurality of prism elements 16 that refract light into the respective light pipes 4. The prisms elements can have any type of design such that most light reaching the sides of the light pipes 4 get total internal reflection. The light collected at the collecting surfaces 7 then travels through the respective light pipes 4 by total internal reflection, and then the collected light is output from the exit surfaces 8, to thereby provide output side emitting beams 14. The output side emitting beams 14 are visible to, for example, a train operator.

It is also the case that some light beams 13 output from the LEDs 1 will directly impinge on the collecting surfaces 7 of the light pipes 4 and also travel through the light pipes 4 and result in the side emitting beams 14. In fact, it may be adequate for only these light beams 13 to be collected if those light beams 13 provide enough illumination in the side emitting beams 14. In that instance the reflected Fresnel loss beams 12 need not be collected, although in an embodiment both the Fresnel loss beams 12 and direct light beams 13 are collected.

Further details of the side emitting status indicator light collecting devices of elements 4–8 is shown in FIGS. 4 and 5. As shown in FIG. 4, the collecting surface 7 of the light pipe 4 includes prism elements 16 integrally formed on the collecting surface 7. Further, the sleeve 5 holds the light pipe 4 with a small air gap 15 therebetween. That is, a small air gap 15 is provided between the light pipe 4 and the sleeve 5, and that air gap 5 ensures the total internal reflection of the light beams passing through the light pipe 4.

Further, since the collecting surfaces 7 of the light pipe 4 are placed near the edge of the housing 6, as shown in FIG. 3, the main light beams 11 output by the LEDs 1 are not interfered with by the collecting surfaces 7, and thereby no shadowing is produced in the main output light beams 11.

Such a structure of the light device 10 provides side emitting signal indicators that provide a true indication of the light output from the same LEDs 1 providing light in a main light output direction. Thereby an enhanced safety operation is achieved.

The light device 10 as described above has been mainly described in the context of a railway indicator signal. However, it is apparent to those of ordinary skill in the art that the light device 10 can be used in other contexts in which a side indication whether a light signal is being output in a primary direction is desirable.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A light device comprising:

(a) a light source comprising at least one light emitting diode (LED), and to generate a majority of output light in a primary direction toward a front of the light device;

(b) a lens device through which the light generated from said light source passes; and (c) a collection optical unit to capture a portion of the light generated from said light source and having a light output surface at a side of the light device, and to output the captured light in a direction other than the primary direction toward the side of the light device, wherein said lens further reflects a portion of the light generated from said light source, and said collection optical unit further captures the reflected portion of the light generated from said light source, and outputs that captured reflected light in the direction other than the primary direction.

2. A light device according to claim 1, wherein said collection optical unit (c) comprises (c1) a light pipe with (c2) a collecting surface and (c3) the light output surface.

3. A light device according to claim 2, wherein the collecting surface (c2) of the light pipe comprises a plurality of prism elements.

4. A light device according to claim 2, further comprising:

(d) a sleeve configured to hold said light pipe, and wherein an air gap is provided between said sleeve and said light pipe.

5. A light device according to claim 1, wherein said lens device (b) comprises (b1) an inner lens and (b2) an outer lens.

6. A light device comprising:

(a) light source means for generating a majority of light in a primary direction toward a front of the light device;

(b) lens means through which the light generated from said light source means passes; and (c) collection means for capturing a portion of the light generated from said light source means and having a light output surface at a side of the light device, and for outputting the captured light in a direction other than the primary direction toward the side of the light device;

wherein said lens means further reflects a portion of the light generated from said light source means, and said collection means further captures the reflected portion of the light generated from said light source means, and outputs that captured reflected light in the direction other than the primary direction.

7. A light device according to claim 6, wherein said collection means (c) comprises (c1) light pipe means with (c2) a collecting surface means and (c3) the light output surface.

8. A light device according to claim 7, wherein said collecting surface means (c2) of the light pipe means comprises a plurality of prism means.

9. A light device according to claim 7, further comprising:

(d) holding means for holding said light pipe means with an air gap provided between said holding means and said light pipe means.

10. A light device according to claim 6, wherein said lens means (b) comprises (b1) an inner lens means and (b2) an outer lens means.

11. A light device comprising:

(a) a light source comprising at least one light emitting diode (LED), and to generate light in a primary direction toward a front of the light device;

(b) a lens device through which the light generated from said light source passes, and said lens device further reflecting a portion of the light generated from said light source; and (c) a collection optical unit to capture the reflected portion of the light generated from said light source and having a light output surface at a side of the light device, and to output the captured reflected light in a direction other than the primary direction toward the side of the light device.

12. A light device according to claim 11, wherein said collection optical unit (c) comprises (c1) a light pipe with (c2) a collecting surface and (c3) the light output surface.

13. A light device according to claim 12, wherein said collecting surface (c2) of the light pipe comprises a plurality of prism elements.

14. A light device according to claim 12, further comprising:

(d) a sleeve configured to hold said light pipe, and wherein an air gap is provided between said sleeve and said light pipe.

15. A light device according to claim 11, wherein said lens device (b) comprises (b1) an inner lens and (b2) an outer lens.

16. A light device comprising:

(a) light source means for generating light in a primary direction toward a front of the light device;

(b) lens means through which the light generated from said light source means passes, and said lens means for further reflecting a portion of the light generated from said light source means; and (c) collection means for capturing the reflected portion of the light generated from said light source means and having a light output surface at a side of the light device, and for outputting the captured reflected light in a direction other than the primary direction toward the side of the light device.

17. A light device according to claim 16, wherein said collection means (c) comprises (c1) light pipe means with (c2) a collecting surface means and (c3) the light output surface.

18. A light device according to claim 17, wherein said collecting surface means (c2) of the light pipe means comprises a plurality of prism means.

19. A light device according to claim 17, further comprising:

(d) holding means for holding said light pipe means with an air gap provided between said holding means and said light pipe means.

20. A light device according to claim 16, wherein said lens means (b) comprises (b1) an inner lens means and (b2) an outer lens means.

* * * * *